US006076753A

United States Patent [19]

Maciejewski et al.

[11] Patent Number: 6,076,753

[45] **Date of Patent: *Jun. 20, 2000**

[54] AGITATED SLURRY PUMP BOX FOR OIL SAND HYDROTRANSPORT

[75] Inventors: Waldemar Maciejewski, Edmonton; George Cymerman, Edmonton; Jim McTurk; Derrick Kershaw, both of Fort McMurray, all of Canada

[73] Assignees: AEC Oil Sands, L.P.; AEC Oil Sands Limited Partnership; Athabasca Oil Sands Investments Inc.; Canadian Occidental Petroleum Ltd.; Canadian Oil Sands Investments Inc.; Gulf Canada Resources Limited; Imperial Oil Resources, all of, Canada; Mocal Energy Limited, Japan; Murphy Oil Company Ltd.; Petro-Canada, both of Canada

[ * ] Notice: This patent is subject to a terminal disclaimer.

[21] Appl. No.: 09/348,233

[22] Filed: Jul. 6, 1999

Related U.S. Application Data

[62] Division of application No. 09/013,935, Jan. 27, 1998, Pat. No. 5,964,277.

[51] Int. Cl.[7] ..... B02C 19/12

[52] U.S. Cl. ..... 241/62; 241/80; 241/81; 241/101.8

[58] Field of Search ..... 366/137, 165.3, 366/348; 241/24.11, 101.8, 21, 80, 81, 25, 62

[56] References Cited

U.S. PATENT DOCUMENTS 2,492,421 12/1949 Golben ..... 241/101.8
5,772,127 6/1998 Maciejewski et al. ..... 241/29

*Primary Examiner*—Mark Rosenbaum
*Attorney, Agent, or Firm*—Millen, White, Zelano & Branigan, P.C.

[57] ABSTRACT

A large, mechanically agitated pump box is used between a mixer, for mixing oil sand and water to produce a slurry, and a pipeline for conveying the slurry to a processing facility. Prior to the aqueous slurry being discharged into the pump box from the mixer, it is screened to reject large solids. The oversize is directed to an impactor where it is comminuted and the comminuted product is screened again prior to being discharged into the pump box. The pump box is designed to increase the residence time of the slurry in the pump box and to separate the slurry into two phases, the suspended slurry and the larger lumps that cannot be suspended. The larger lumps that settle in the pump box are recycled to the impactor for comminution.

3 Claims, 1 Drawing Sheet

AGITATED SLURRY PUMP BOX FOR OIL SAND HYDROTRANSPORT

This is a division of application Ser. No. 09/013,935 filed Jan. 27, 1998, now U.S. Pat. No. 5,954,277.

FIELD OF THE INVENTION

This invention relates to an assembly and process for forming an aqueous oil sand slurry, screening it to remove oversize solids, mechanically agitating it and conditioning it, to produce a slurry ready for pipelining.

BACKGROUND OF THE INVENTION

The McMurray oil sands of Alberta constitute one of the largest deposits of hydrocarbons in the world. The oil sands are first mined at a mine site and then transported to an extraction plant in order to extract the bitumen. In recent years the preferred mode of transport of mined oil sands has been by way of a slurry pipeline. The oil sand is mixed with water to form a slurry that is capable of being pumped down a pipeline to the extraction plant.

One needs to provide a suitable means for slurrying the oil sand with water and entraining air to produce a slurry that is suitable for pumping down the pipeline. The as-mined oil sand contains a variety of lumps including rocks, clay and oil sand lumps. Therefore a mixer means is required that not only slurries the oil sand but also ensures that oversize lumps that are unsuitable for pumping and feeding into the pipeline are rejected. A typical aqueous slurry comprises the following: bitumen froth, sand, smaller lumps of oil sand, clay and/or rocks (between 0 and 2 inches in diameter) and larger lumps of oil sand, clay and/or rock (between 2 and 4 inches in diameter).

In U.S. Pat. No. 5,039,227, issued to Leung et al and assigned to the owners of the present application, one mixer circuit for this purpose has been disclosed.

In the Leung et al mixer circuit, an oil sand stream is dropped from the end of a conveyor into a mixer tank. The mixer tank is open-topped, has a cylindrical body and conical bottom and forms a central bottom outlet. A swirling vortex of slurry is maintained in the tank and the incoming oil sand and added water is fed into it. Slurry leaves the tank through the bottom outlet, is screened using vibrating screens to reject oversize, and is temporarily collected in an underlying pump box. Some of the slurry in the pump box is withdrawn and pumped back through a return line to be introduced tangentially into the mixer tank to form the swirling vortex. The balance of slurry in the pump box is withdrawn and pumped into the pipeline.

In a co-pending application, a second-generation mixer circuit in the form of a vertically oriented stack of components, functions to slurry the oil sand with water. The oil sand is initially dropped from the end of a conveyor and is contacted in mid-air with a stream of water. The mixture drops into a downwardly slanted trough and the water and oil sand mixes as they move turbulently through the open-ended trough. The slurry is deflected as it leaves the trough and is spread in the form of a thin sheet on an apron. It is then fed over screens to reject oversize lumps. The screened slurry drops into a pump box where it is temporarily retained. The rejected lumps are comminuted in an impactor positioned at the end of the screens. The comminuted oil sand is screened to remove remaining oversize lumps and the screened comminuted oil sands are delivered into the pump box. The slurry in the pump box is withdrawn and pumped into the pipeline.

Both of the prior art mixer circuits routinely produce a slurry that contains lumps ranging from 0 to 4 inches in diameter. Before the slurry is pumped to the pipeline, it is temporarily stored in a pump box. The pump box is restricted to a certain volume because if the volume of retained slurry is too great, settling of the sand and lumps will occur. As a result, the residence time of the slurry in the pump box is relatively short (in the order of 1 minute) and the slurry is quickly pumped from the pump box to the pipeline.

As the slurry travels down the pipeline, slurry conditioning or digestion takes place. Adequate conditioning is critical for good bitumen recovery in a downstream separation vessel and is especially important when extracting bitumen from low grade oil sand. Basically what conditioning means is that the larger oil sand lumps are ablated into smaller lumps and bitumen flecks coalesce and coat or attach to air bubbles. The lumps need to be dispersed in water to promote the release of oil droplets and the attachment of air. Conditioning also benefits from turbulent pipeline flow and is dependent upon the length of the pipeline, hence, the length of time that the slurry resides in the pipeline before reaching the separation vessel. The larger the oil sand lumps, the more time required to digest or ablate these lumps to release the bitumen flecks. Therefore if a slurry is routinely produced that contains large lumps, there will be a need for long pipelines or residence time.

An ideal slurry for fast conditioning (i.e. under 10 minutes) would be one that consists of lumps that are less than 2 inches in diameter. But producing such a slurry is impractical due to limitations of the prior art mixer circuits. For example, in the second-generation mixer circuit, slurry routinely contains lumps that are 2 to 4 inches in diameter. This is as a result of limitations in the mixer circuit with respect to the screening process. These circuits must accommodate large throughputs of oil sand. Therefore, the screen openings must be considerably larger than 2 inches, hence, larger lumps (i.e. 2 to 4 inches in diameter) are introduced into the pipeline. This means that the pipeline has to be a certain length to ensure sufficient residence time of such a slurry (preferably a minimum of 4 km to give a residence time of approximately 12 to 15 minutes) for proper conditioning to occur.

There may be times, however, when it is unnecessary to have such a long pipeline. But if the pipeline is too short, the residence time of the slurry in the pipeline will be too short for proper conditioning of the slurry to occur. This will result in a decrease in bitumen recovery. However, a pump box can be designed whereby the harder to digest 2 to 4 inch lumps are segregated from the rest of the slurry and are directed to an impactor where they are comminuted to small lumps. Therefore the length of the pipeline becomes less critical.

SUMMARY OF THE INVENTION

This invention relates to an assembly and process for forming an aqueous oil sand slurry whereby the slurry contains preferably lumps that are about 2 inches or less in diameter prior to the slurry being pumped to the pipeline.

In the prior art, a pump box is used to temporarily store the aqueous slurry prior to being pumped through the pipeline. In the current invention, the cross-sectional area of the pump box is increased relative to what was conventional and a mixing means is added to the pump box. This accomplishes two things. First, the slurry is separated into two phases: a suspended slurry with lumps 2 inches in diameter or less and larger lumps that cannot be suspended and therefore settle to the bottom of the pump box. In a preferred feature, the larger lumps that settle to the bottom are pumped out of the pump box, directed to a 2 inch screen deck and the reject lumps are comminuted in an impactor. The comminuted product is delivered back to the pump box. Over time, the overall effect is that the slurry being introduced into the pipeline contains only lumps that are about 2 inches or less. Hence, conditioning of the slurry occurs much faster, thereby eliminating the need for long pipelines for conditioning.

Second, the actual residence time of the slurry in the pump box is increased relative to the prior art due to the fact that the cross-sectional area of the pump box has been increased relative to the prior art. Therefore, some conditioning of the slurry will take place in the pump box itself, rather than in the pipeline. Both the volume of the pump box and the flow rate of the slurry will determine the residence time of the slurry in the pump box. The following equation can be used to determine the residence time:

$$\text{volume } (m^3)/\text{flow rate } (m^3/\text{min}) = \text{residence time (min)}.$$

In practice, it is desirable to keep the slurry flow rate relatively constant. Therefore, the optimal way to increase residence time is to increase the volume of the pump box. This can be achieved by increasing the cross-sectional area of the pump box.

In one broadly stated aspect of the invention, a process is provided for producing an aqueous slurry of oil sand, ready for introduction into a pipeline, comprising:

mixing oil sand and water to form an aqueous slurry;

screening the slurry to remove oversize and produce a screened slurry;

temporarily retaining the screened slurry in a pump box;

mechanically agitating the slurry contained in the pump box to suspend lumps; and withdrawing slurry from the pump box and pumping it into a pipeline.

In another broadly stated aspect of the invention, a downwardly sequenced assembly is provided for producing an aqueous slurry of oil sand, ready for introduction into a pipeline, comprising:

means for mixing oil sand with water to produce a slurry;

means for screening oversize lumps from the slurry to produce a screened slurry containing solids suitable for pumping through a pipeline; and a pump box for receiving the screened slurry, said pump box having means for mechanically agitating the slurry within the pump box, said pump box being associated with a means for withdrawing slurry from the pump box and pumping it into a pipeline.

More specifically, in a preferred form, the downwardly sequenced assembly for producing an aqueous slurry of oil sand, ready for introduction into a pipeline, comprises:

A conveyor having a discharge end for delivering a continuous stream of oil sand that falls through air into a trough;

A pipe for delivering a stream of water which contacts and wets the falling oil sand in mid-air;

The trough being downwardly slanted, open-topped and positioned in spaced relation below the conveyor discharge end and the water pipe. The trough is operative to receive the mixture of oil sand and water and confine it temporarily to allow the oil sand and water to turbulently mix and form a slurry stream as they flow along its length and discharge from its open lower end;

An upstanding wall positioned adjacent the trough's lower end and spaced therefrom so that the slurry stream hits it and is deflected, with the result that its direction of flow is changed and further mixing is induced;

An apron providing a broad surface for receiving the deflected stream, whereby the stream is spread out and thinned to form a slurry sheet adapted to efficiently utilize the screen area;

A first screen assembly for receiving and screening the slurry sheet to reject oversize and produce a screened slurry stream;

A pump box for receiving and temporarily retaining the screened slurry;

A mechanical agitator in the pump box for separating the screened slurry into two phases, the slurry containing suspended lumps and the larger lumps that cannot be suspended; and A means for withdrawing suspended slurry from the pump box and delivering the slurry into the pipeline.

In a preferred extension of the invention, the rejected oversize lumps from the first screen assembly are fed directly into an impactor and comminuted. The comminuted product is screened by a second screen assembly to reject remaining oversize. The comminuted, screened product is then delivered into the mechanically agitated pump box.

In a second preferred extension of the invention, the mechanically agitated pump box is equipped with a means for recycling lumps reaching the bottom of the pump box, preferably by withdrawing them tangentially from the bottom of the pump box. These lumps are delivered to a third screen which may be attached to the first screen assembly. The rejected oversize lumps are then fed directly into the impactor to be comminuted in the impactor. The comminuted product is then delivered into the mechanically agitated pump box.

DESCRIPTION OF THE PREFERRED EMBODIMENT

Figure 1:
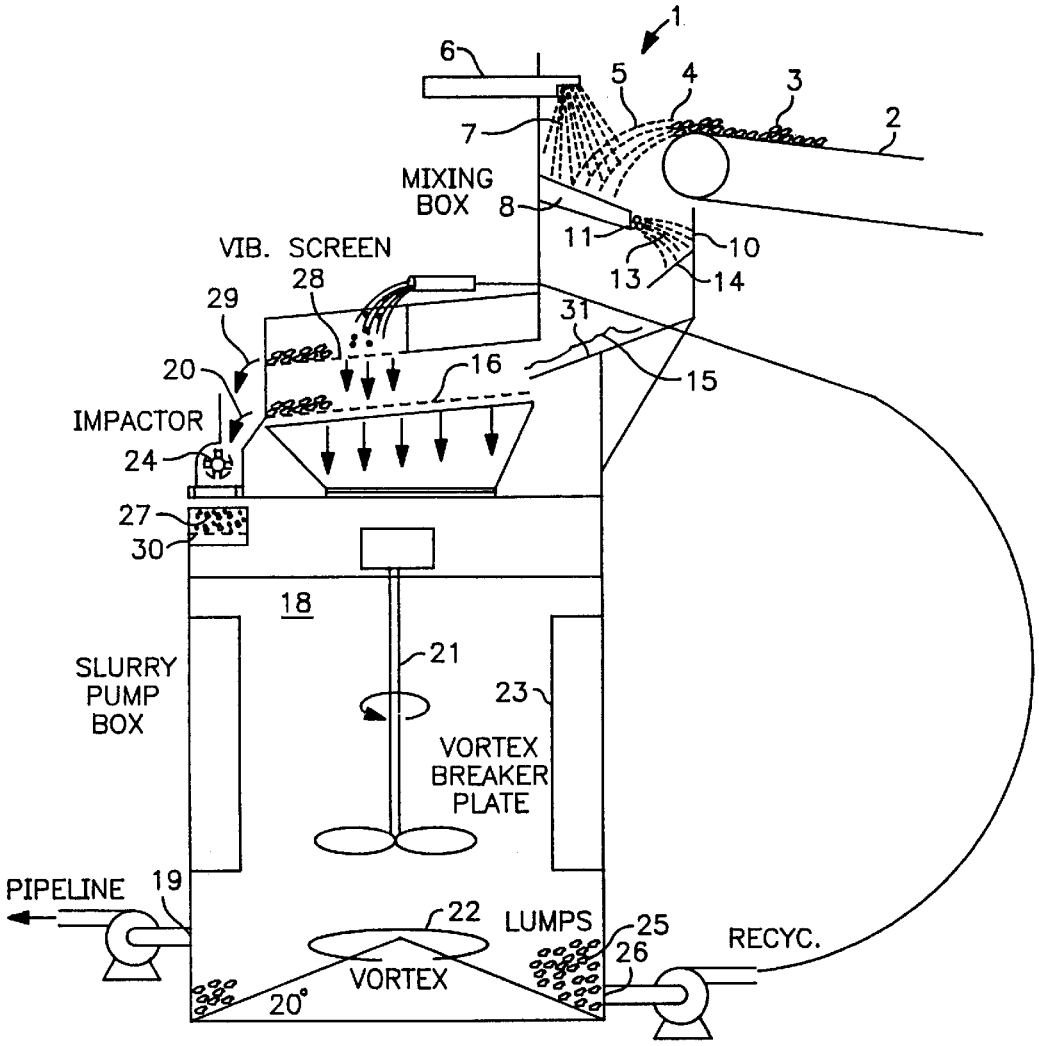
FIG. 1 is a schematic side view showing the preferred embodiment of the invention.

As-mined oil sand to be pipelined is first crushed before conveying it to a mixer circuit 1. This is commonly done by passing it through a set of double rolls, producing 24-inch product. This pre-treatment (which forms no part of the invention) is done to break down the very large contained lumps.

The crushed oil sand contains lumps of varying size and composition.

The mixer circuit 1 comprises a series of downwardly arranged components.

The uppermost component is a conveyor 2 for continuously delivering a stream of crushed oil sand 3. The oil sand cascades or falls from the discharge end 4 of the conveyor 2—it drops downwardly through an air space 5.

A horizontal pipe 6 is positioned opposite to the conveyor discharge end 4. The pipe discharges a stream 7 of water into the falling oil sand in mid-air at a sufficient rate so that the water/oil sand ratio is equivalent to that of the pipeline slurry. Typically this ratio is about 1:3 by weight. The stream 7 contacts the downwardly descending oil sand and is distributed through it and wets it.

The oil sand and water drop into a downwardly slanted, open-topped, open-ended trough 8. The trough is formed of plate steel.

As the oil sand and water move through the trough, they mix turbulently and form a slurry.

A solid, vertical wall 10 formed of steel is positioned adjacent the lower end 11 of the trough 8. The wall 10 is spaced from the trough's lower end 11 and extends across the trajectory path of the slurry stream 13 discharging from the trough.

A downwardly slanted apron 14 extends downwardly from the wall 10 in a direction opposite to that of the trough 8.

The slurry stream 13 hits the wall 10, is deflected and changes its direction of movement, being discharged onto an apron 14. In the course of these movements, further turbulent mixing of the oil sand and water occurs. On reaching a second apron 31, the slurry spreads out laterally and is thinned, to form a slurry sheet 15 of comparable width to the screen 16.

The slurry sheet 15 flows from the second apron 31 onto a contiguous first vibrating screen 16. It is sized to retain +4 inch material.

The oversize lumps 20 retained by the vibrating screen 16 are delivered into an impactor 24. The lumps 20 are largely oil sand in composition and many disintegrate when impacted by the rotating arms of the impactor, producing comminuted product 27. This product discharges from the outlet of the impactor onto a second vibrating screen 30. The oversize lumps retained by screen 30 are discarded. The screened comminuted product is discharged into pump box 18.

Pump box 18 is equipped with a vertical shaft agitator 21 that mechanically agitates the collected screened slurry such that a vortex 22 is created. The pump box is further equipped with at least one vortex breaker plate 23 positioned so as to allow the vortex 22 to form at the bottom of the pump box. Much of the slurry remains in suspension and only the larger lumps 25 (between 2 and 4 inches in diameter) settle to the bottom of the pump box 18. The larger lumps are pumped from a tangential outlet 26 and are delivered to a third vibrating screen 28 that is sized to retain +2 inch material. The oversize lumps 29 retained by the screen 28 are delivered into the impactor 24. Most of the oversize lumps are disintegrated when impacted by the rotating arms of the impactor 24. The comminuted product is discharged into the pump box 18. Ultimately, the suspended slurry in the pump box is pumped from an outlet 19 into a pipeline.

The foregoing describes our best mode of carrying out the invention. As will be realized, the invention is capable of other and different embodiments and its several details are capable of variation, all without departing from the invention. The scope of the invention is established in the claims now following.

The embodiments of the invention in which an exclusive property or privilege is claimed are defined as: follows:

1. A downwardly sequenced assembly for producing an aqueous slurry of oil sand, ready for introduction into a pipeline, comprising:

means for mixing oil sand with water to produce a slurry;

means for screening oversize lumps from the slurry to produce a screened slurry containing solids suitable for pumping through a pipeline; and a pump box for receiving the screened slurry, said pump box having means for mechanically agitating the slurry within the pump box, said pump box being associated with a means for withdrawing slurry from the pump box and pumping it into a pipeline.

2. The assembly as set forth in claim 1 comprising:

an impactor, associated with the screening means, for receiving the screened oversize, comminuting it to produce comminuted solids and screening the comminuted solids to reject remaining oversize and pass solids suitable for pumping through the pipeline; and means for downwardly transferring the screened comminuted solids into the pump box.

3. The assembly as set forth in claim 2 comprising:

means for recycling a stream of slurry from the base of the pump box, said stream containing lumps that have reached the bottom of the pump box;

a screening means for processing the recycled slurry to remove oversize lumps, feeding said oversize lumps to the impactor and returning screened slurry to the pump box.

* * * * *